US007418952B2

(12) United States Patent
Kano et al.

(10) Patent No.: US 7,418,952 B2
(45) Date of Patent: Sep. 2, 2008

(54) EVAPORATIVE FUEL TREATMENT SYSTEM

(75) Inventors: Masao Kano, Gamagori (JP); Shinsuke Takakura, Kariya (JP); Noriyasu Amano, Gamagori (JP); Shinsuke Kiyomiya, Seto (JP); Yuusaku Nishimura, Toyota (JP)

(73) Assignees: Denso Corporation (JP); Nippon Soken, Inc. (JP); Toyota Jidosha Kabushiki Kaisha (JP)

( * ) Notice: Subject to any disclaimer, the term of this patent is extended or adjusted under 35 U.S.C. 154(b) by 180 days.

(21) Appl. No.: 11/522,523

(22) Filed: Sep. 18, 2006

(65) Prior Publication Data

US 2007/0062495 A1 Mar. 22, 2007

(30) Foreign Application Priority Data

Sep. 16, 2005 (JP) ..... 2005-269867

(51) Int. Cl.
*F02M 25/08* (2006.01)
*F02M 33/02* (2006.01)

(52) U.S. Cl. ..... 123/520; 73/114.39

(58) Field of Classification Search ..... 123/516, 123/518–520; 73/114.39
See application file for complete search history.

(56) References Cited

U.S. PATENT DOCUMENTS 5,315,980 A * 5/1994 Otsuka et al. ..... 123/520
6,971,375 B2 12/2005 Amano et al.
2005/0022588 A1* 2/2005 Hayakawa et al. ..... 73/118.1
2006/0144373 A1 7/2006 Kano et al.
2006/0225714 A1* 10/2006 Kano et al. ..... 123/520

FOREIGN PATENT DOCUMENTS

JP 6-101534 4/1994
JP 5-018326 1/1996

OTHER PUBLICATIONS

U.S. Appl. No. 11/398,755, filed Apr. 6, 2006.

* cited by examiner

*Primary Examiner*—Thomas N Moulis
(74) *Attorney, Agent, or Firm*—Nixon & Vanderhye PC

(57) ABSTRACT

An evaporative fuel treatment system is disclosed that includes a canister, a detection passage having a reduced area portion, and switching device that switches fluid communication. Also included is a depressurizing device for depressurizing the detection passage coupled to the detection passage on a side of the reduced area portion opposite to the switching device, and a pressure detecting device. Moreover, the system includes an evaporative fuel state calculating device for calculating an evaporative fuel state in the mixture based on a cutoff pressure, an air pressure, and a mixture pressure of a mixture of air and the evaporative fuel. In one embodiment, the cutoff pressure, the air pressure, and the mixture pressure are detected independently and discontinuously. In another embodiment, the cutoff pressure and the air pressure are detected on a continual basis during purge of the evaporative fuel.

19 Claims, 15 Drawing Sheets

EVAPORATIVE FUEL TREATMENT SYSTEM

CROSS REFERENCE TO RELATED APPLICATION

The following is based on and claims priority to Japanese Patent Application No. 2005-269867, filed Sep. 16, 2005, which is incorporated herein by reference.

FIELD

The following relates to an evaporative fuel treatment system with a canister into which evaporative fuel is adsorbed and from which the evaporative fuel is purged into an intake air passage.

BACKGROUND

An evaporation fuel processor has been proposed having a canister into which evaporative fuel generated in a fuel tank is temporarily adsorbed. As the need arises, the evaporative fuel is purged from the canister to an intake air passage of an engine.

For instance, Japanese Patent Publication No. 05-018326 and Japanese Patent Publication No. 06-101534 each disclose such an evaporative fuel treatment system. The system calculates an evaporative fuel concentration in a mixture to be purged to the intake air passage prior to purging. More specifically, the system detects a flow rate or a density of an air-fuel mixture in a passage through which the air-fuel mixture is purged to the intake air passage. Furthermore, the system detects a flow rate or a density of air in a passage open to the atmosphere. The system calculates the evaporative fuel concentration from a ratio of these detection results.

In this conventional system, a negative pressure of the intake air passage is applied to each passage, whereby the mixture or air flows through each passage and the flow rate or density is detected. With this configuration, when pulsation occurs in the negative pressure of the intake air passage, a fluctuation will arise in the flow rate or density. Therefore, calculation of the evaporative fuel concentration based on the flow rate or density becomes less accurate. Moreover, where the negative pressure of the intake air passage is small, the flow rate of the mixture or air in each passage is also relatively small. Accordingly, detection of the flow rate or density itself can be difficult.

Accordingly, an evaporative fuel treatment system has been proposed that depressurizes a detection passage having a reduced area portion (i.e., orifice, throttle, contraction, reference passage, etc.) with depressurizing means (e.g., a pump). The system detects a cutoff pressure of the detection passage with the atmosphere side of the reduced area portion blocked. The system also detects an air pressure with the reduced area portion and the atmosphere brought into communication. Furthermore, the system detects a mixture pressure of the mixture with the reduced area portion and the canister being brought into communication as a differential pressure at both sides of the reduced area portion. The system calculates the evaporative fuel concentration based on the cutoff pressure, the air pressure, and the mixture pressure. Since the detection passage is depressurized by a pump, the differential pressure of a detection object is stabilized if there is substantially no change in detecting conditions, and the flow rate of air or mixture is sufficiently maintained in the detection passage.

In contrast to this, an evaporative fuel treatment system illustrated in FIG. 19 detects the cutoff pressure $P_t$, the air pressure $\Delta P_{AIR}$, and the mixture pressure $\Delta P_{GAS}$ on a continual basis. In addition, until detection of these three kinds of pressures is completed, a purge valve is closed and purging the evaporative fuel is not performed. As a result, a substantial amount of time may elapse during which the purge cannot be performed due to detection of the three kinds of pressures. In another case, when the three kinds of pressures cannot be detected on a continual basis because a pressure detectable time is short, the purge cannot be performed until the three kinds of pressures are detected. Accordingly, even when the purge execution condition exists, the purge may not occur. This incapability may lead to decrease in the number of purges. Start of the purge may also be delayed, which can cause a shorter purge time, and accordingly the quantity of the purged evaporative fuel may be decreased.

SUMMARY OF THE INVENTION

An evaporative fuel treatment system is disclosed that includes a canister into which an evaporative fuel is adsorbed and from which the evaporative fuel is purged into an intake air passage of an engine. The system also includes a detection passage having a reduced area portion. Furthermore, the system includes a switching device that switches among communication of the reduced area portion and an atmosphere, communication of the reduced area portion and the canister, and shutoff of communication between the reduced area portion, the atmosphere, and the canister. The system additionally includes a depressurizing device coupled to the detection passage on a side of the reduced area portion opposite to the switching device. The depressurizing device is operable for depressurizing the detection passage. The system further includes a pressure detecting device for detecting pressure in the detection passage. Moreover, the system includes an evaporative fuel state calculating device for calculating an evaporative fuel state in the mixture based on a cutoff pressure detected by the pressure detecting device when the depressurizing device is in operation and when the switching device shuts off communication between the atmosphere and the canister, an air pressure detected by the pressure detecting device when the reduced area portion and the atmosphere are in communication and when the switching device shuts off communication between the reduced area portion and the canister, and a mixture pressure of a mixture of air and the evaporative fuel detected by the pressure detecting device when the switching device shuts off communication between the reduced area portion and the atmosphere and the reduced area portion and the canister are in communication during purge stop of the evaporative fuel from the canister to the intake air passage. The cutoff pressure, the air pressure, and the mixture pressure are detected independently and discontinuously.

An evaporative fuel treatment system is also disclosed that includes a canister into which an evaporative fuel is adsorbed and from which the evaporative fuel is purged into an intake air passage of an engine. The system also includes a detection passage having a reduced area portion. Furthermore, the system includes a switching device that switches among communication of the reduced area portion and an atmosphere, communication of the reduced area portion and the canister, and shutoff of communication between the reduced area portion, the atmosphere, and the canister. The system additionally includes a depressurizing device coupled to the detection passage on a side of the reduced area portion opposite to the switching device. The depressurizing device is operable for depressurizing the detection passage. The system further includes a pressure detecting device for detecting pressure in the detection passage. Moreover, the system includes an evaporative fuel state calculating device for calculating an evaporative fuel state in the mixture based on a cutoff pressure detected by the pressure detecting device when the depressurizing device is in operation and when the switching device shuts off communication between the atmosphere and the canister, an air pressure detected by the pressure detecting device when the reduced area portion and the atmosphere are in communication and when the switching device shuts off communication between the reduced area portion and the canister, and a mixture pressure of a mixture of air and the evaporative fuel detected by the pressure detecting device when the switching device shuts off communication between the reduced area portion and the atmosphere and the reduced area portion and the canister are in communication during purge stop of the evaporative fuel from the canister to the intake air passage. The cutoff pressure and the air pressure are detected on a continual basis during purge of the evaporative fuel from the canister to the intake air passage.

DETAILED DESCRIPTION OF THE PREFERRED EMBODIMENTS

Hereafter, multiple embodiments will be described based on the drawings.

First Embodiment

Figure 1:
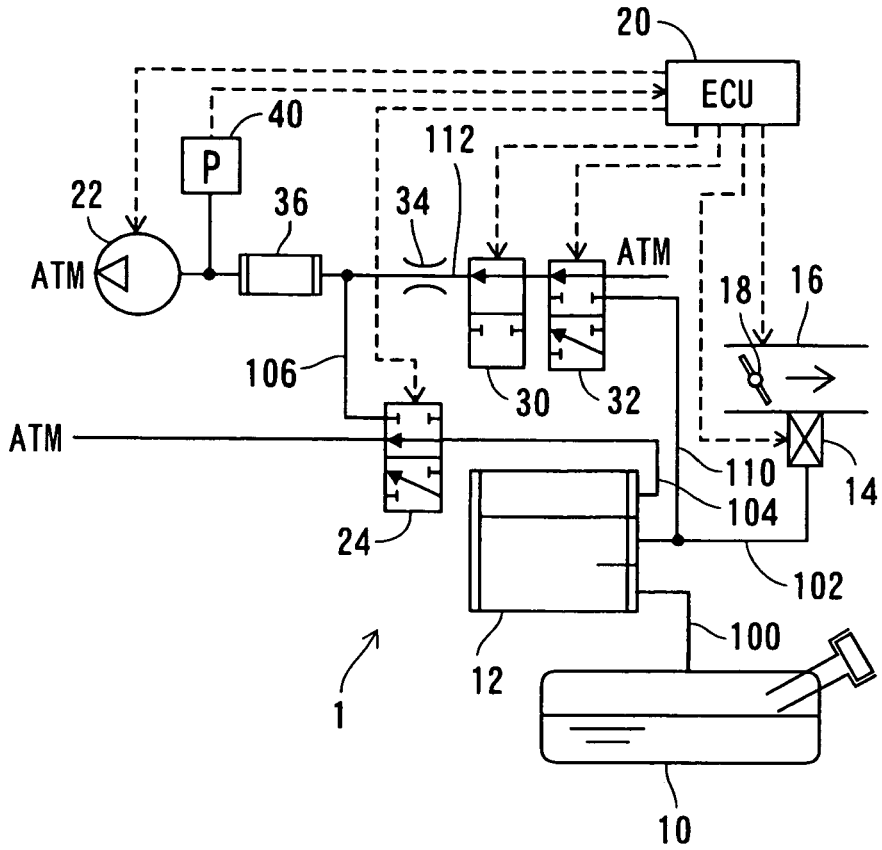
FIG. 1 is a schematic view of one embodiment of an evaporative fuel treatment system.

FIG. 1 shows one embodiment of an evaporative fuel treatment system 1. As shown, a fuel tank 10 and a first canister 12 are connected by a passage 100, and evaporative fuel generated in the fuel tank 10 flows through the passage 100 and adsorbed by adsorbent, such as activated carbon, in the first canister 12. By opening a purge valve 14, the evaporative fuel adsorbed by the first canister 12 flows through a purging passage 102 from the first canister 12 by a negative pressure of an intake air passage 16, and is purged to the intake air passage 16 downstream a throttle valve 18.

The evaporative fuel treatment system 1 calculates an evaporative fuel concentration in a mixture of air and the evaporative fuel both purged to the intake air passage 16. The system 1 also controls a fuel injection quantity from a fuel injection valve (not shown) according to the calculated evaporative fuel concentration. The evaporative fuel treatment system 1 operates the purge valve 14, the throttle valve 18, a pump 22, and electromagnetic valves 24, 30, 32 according to an instruction of a control unit 20 (ECU). In this embodiment, the ECU corresponds to the evaporative fuel state calculating device of the claims.

The electromagnetic valve 24 is a three-way electromagnetic valve, and opens a passage 104 connecting the first canister 12 to the atmosphere side in the state shown in FIG. 1. When the purge valve 14 opens in this state, the evaporative fuel adsorbed by the first canister 12 is purged to the downstream side of the throttle valve 18 through the purging passage 102 due to the negative pressure of the intake air passage 16. When performing a leak check of the evaporative fuel treatment system 1, the electromagnetic valve 24 brings the passage 104 into communication with a passage 106 coupled to the pump 22 (i.e., the depressurizing device). In this state, when the pump 22 operates, the canister 12 and the passages are depressurized and a leak check is performed.

The electromagnetic valve 30 is a two-way electromagnetic valve for establishing or shutting off communication between a reduced area portion 34 (e.g., contraction, orifice, throttle, etc.) and the atmosphere. The electromagnetic valve 32 is a three-way electromagnetic valve for switching between communication of the reduced area portion 34 and the atmosphere and communication of the reduced area portion 34 and a passage 110 on the first canister 12 side. In the embodiment shown, the electromagnetic valves 30, 32 correlate to the switching device of the claims.

A second canister 36 is disposed in a detection passage 112 between the reduced area portion 34 and the pump 22. The second canister 36 has adsorption material in it, such as activated carbon, similar to the first canister 12. Therefore, when the pump 22 operates to depressurize the detection passage 112, the evaporative fuel adsorbed by the first canister 12 is drawn into the detection passage 112, and when the mixture of air and evaporative fuel that flowed through the reduced area portion 34 is flowing through the second canister 36, the second canister 36 adsorbs the evaporative fuel so that the evaporative fuel is removed from the mixture.

When the mixture of air and the evaporative fuel flows through the reduced area portion 34, a pressure sensor 40 (i.e., differential pressure sensor, pressure detecting device, etc.) detects a pressure of air that flows through the reduced area portion 34. More specifically, the second canister 36 is installed between the pump 22 and the reduced area portion 34. The evaporative fuel is removed from the mixture having flowed through the reduced area portion 34, and a pressure detected by the pressure sensor 40 is larger than a case in which no second canister 36 is included. As a result, a difference between an air pressure $\Delta P_{AIR}$ (detected by the pressure sensor 40 when only air flows through the reduced area portion 34) and a mixture pressure $\Delta P_{GAS}$ (detected by the pressure sensor 40 when the mixture of air and the evaporative fuel flows through the reduced area portion 34) increases.

Thus, a detection gain G that is sufficiently large to pressure resolution of the pressure sensor 40 can be secured. Accordingly the relative detection accuracy of the mixture pressure $\Delta P_{GAS}$ to the air pressure $\Delta P_{AIR}$ is improved. Also, the calculation accuracy of the evaporative fuel concentration is improved.

The pressure sensor 40 is coupled to the detection passage 112 between the pump 22 and the second canister 36 and detects a differential pressure between the atmosphere and the detection passage 112 between the pump 22 and the second canister 36 (i.e., between the pump 22 and the reduced area portion 34). As such, the differential pressure detected by the pressure sensor 40 when the pump 22 operates becomes substantially equal to a differential pressure between both ends of the reduced area portion 34 in the state where the electromagnetic valve 30 is opened. Moreover, in the state where the electromagnetic valve 30 is closed, the detection passage 112 is blocked on the intake side of the pump 22, and the detected pressure of the pressure sensor 40 when the pump 22 operates becomes substantially equal to a cutoff pressure of the pump 22.

Operation of Evaporative Fuel Treatment System 1

Each routine explained below is executed by a program stored in the ECU 20 (i.e., the concentration detecting device).

Figure 8:
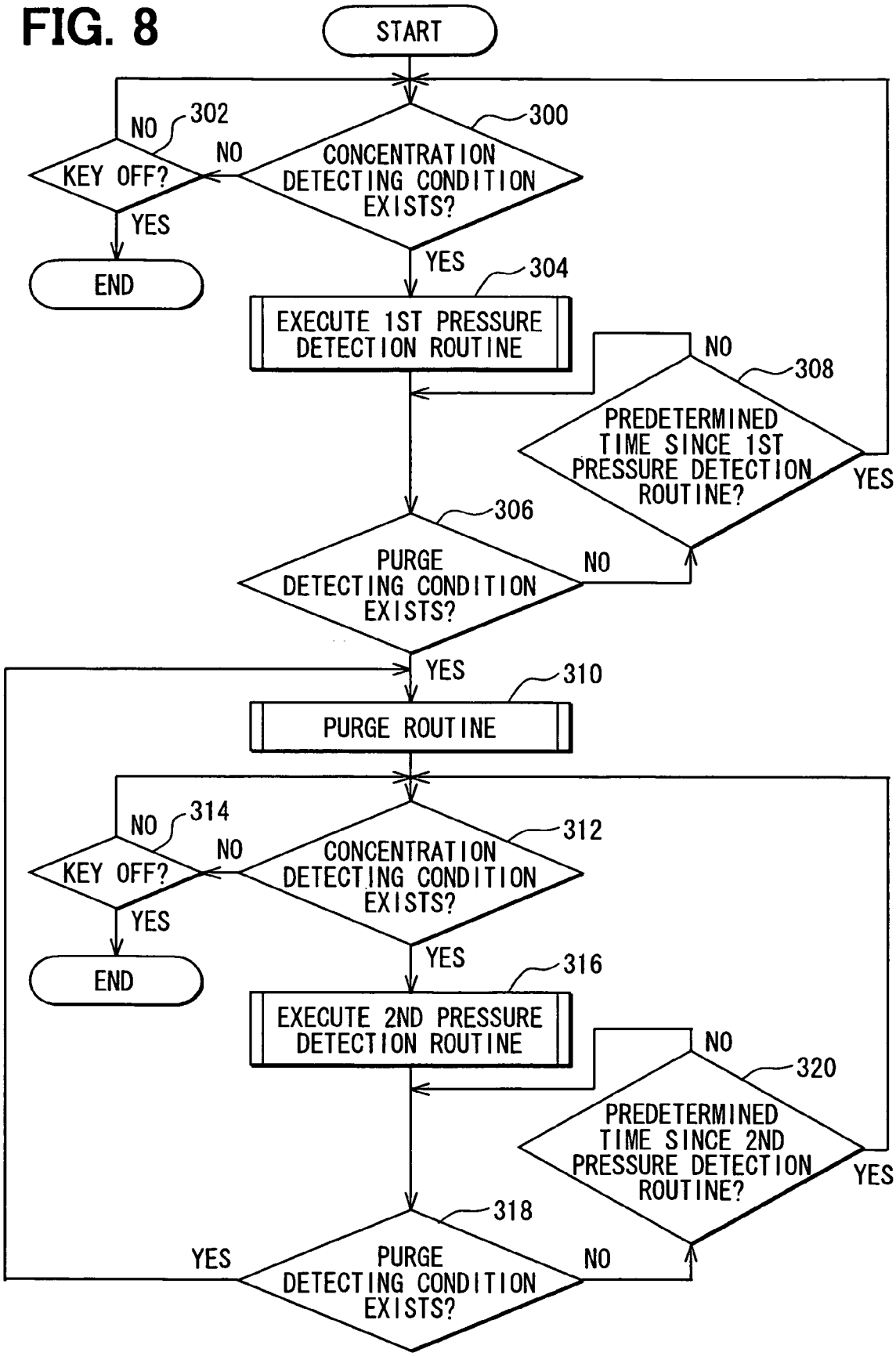
FIG. 8 is a flowchart illustrating a method of calculating an evaporative fuel concentration.

The processing routine shown in FIG. 8 is a main routine for calculating the evaporative fuel concentration and is executed after turning an ignition key to the ON position. In one embodiment, the ECU 20 executes the routine shown in FIG. 13 in parallel with the routine shown in FIG. 8.

As shown in FIG. 8, the ECU 20 determines in Step 300 whether a detecting condition of the evaporative fuel concentration exists. For example, when the engine speed becomes hundreds of rotations or more or water temperature becomes at least a predetermined temperature, the ECU determines in Step 300 that the detecting condition exists. In another embodiment, the ECU 20 determines that the detecting condition of the evaporative fuel concentration exists when the ambient temperature of the fuel tank 10 is at least a predetermined temperature (e.g., a relatively high temperature) because evaporative fuel is more likely to be generated when the ambient temperature is relatively high.

If the detecting condition of the evaporative fuel concentration does not exist, the ECU 20 determines in Step 302 whether the ignition key is turned to the OFF position. If the ignition key is turned OFF, the ECU 20 ends the routine of FIG. 8. If the ignition key is in an ON state, the method returns to Step 300.

Figure 9:
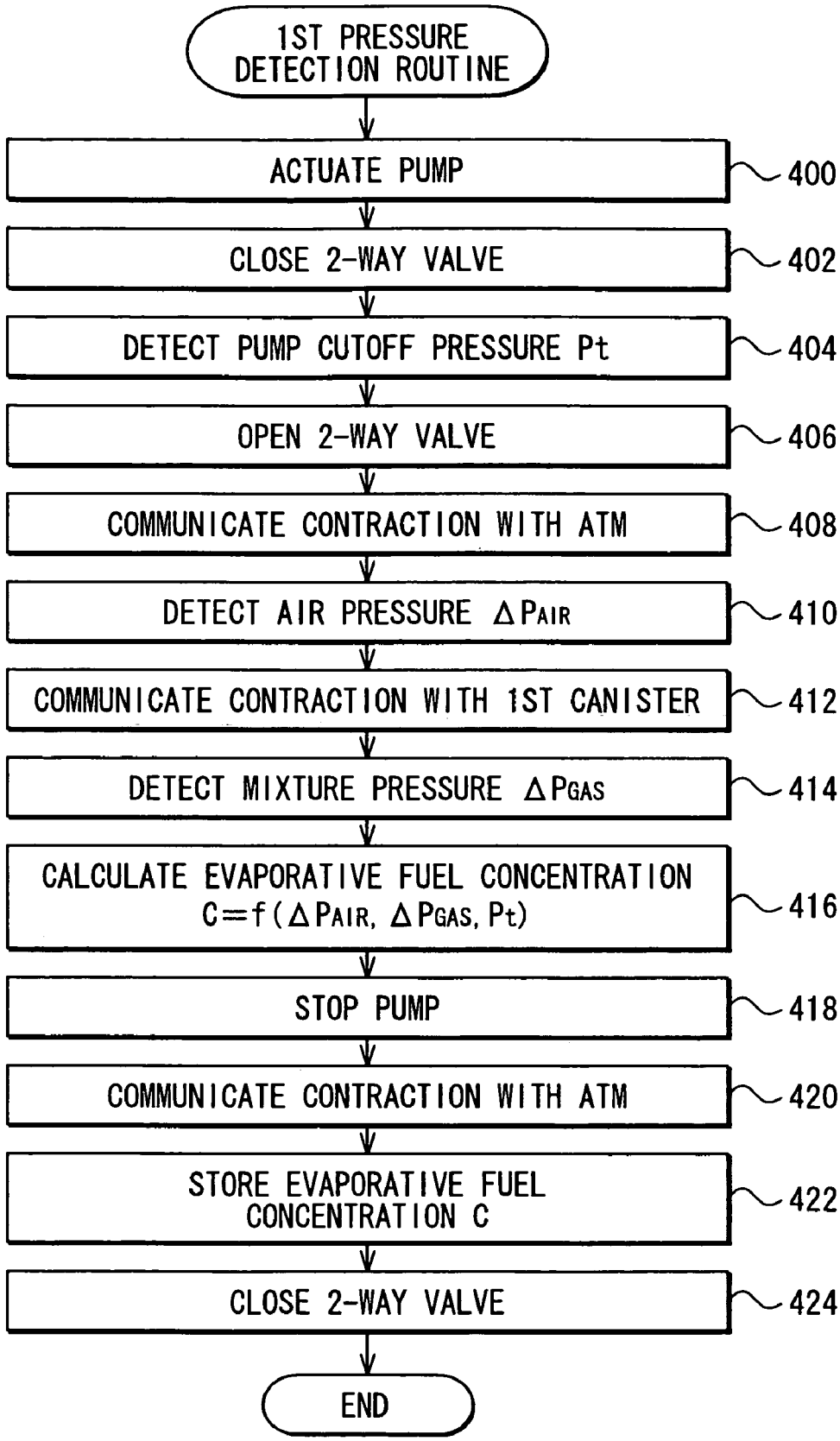
FIG. 9 is a flowchart illustrating a first pressure detection routine.

If the detecting condition of the evaporative fuel concentration exists, the ECU 20 executes the first pressure detection routine in Step 304. The first pressure detection routine is illustrated in FIG. 9 and will be described in greater detail below. Just after turning the ignition key to the ON position to start the internal combustion engine, neither the cutoff pressure, the air pressure, nor the mixture pressure is detected, and the evaporative fuel concentration is not calculated. Thus, first purge is not performed. In one embodiment, the first pressure detection routine is a routine executed only once before performing the first purge. The routine allows for detection of the cutoff pressure, the air pressure, and the mixture pressure on a continual basis. The evaporative fuel concentration is calculated from the cutoff pressure, the air pressure, and the mixture pressure.

Once the evaporative fuel concentration is calculated with the first pressure detection routine, the ECU 20 determines in Step 306 whether the purge execution condition exists. If the purge execution condition does not exist, the ECU 20 determines in Step 308 whether a predetermined time has lapsed after the execution of the first pressure detection routine 1. If the predetermined time has lapsed after the execution of the first pressure detection routine, there is the possibility that an evaporative fuel volume adsorbed by the first canister 12 has changed and the evaporative fuel concentration has changed. In addition, there is the possibility that ambient environment (e.g., temperature) of the evaporative fuel treatment system 1 has changed and the cutoff pressure and the air pressure have changed. In order to reduce these possibilities, if the predetermined time has lapsed after the execution of the first pressure detection routine, the ECU 20 returns to Step 300 and executes the pressure detection routine 1 again in Step 304. Thus, the ECU 20 calculates the evaporative fuel concentration with updated cutoff pressure, air pressure, and mixture pressure by again detecting the cutoff pressure, the air pressure, and the mixture pressure via the first pressure detection routine.

If, in Step 306, the purge execution condition does not exist and the predetermined time has not lapsed after the execution of the first pressure detection routine, the ECU 20 returns to Step 306.

However, if the purge execution condition exists in Step 306, the ECU 20 executes a purge routine in Step 310. The purge routine is a routine for purging the evaporative fuel from the first canister 12 to the intake air passage 16 based on the calculated evaporative fuel concentration. The purge routine will be explained in greater detail below.

When the purge routine is ended, the ECU 20 determines in Step 312 whether the detecting condition of the evaporative fuel concentration exists. If the detecting condition of the evaporative fuel concentration does not exist, the ECU 20 determines in Step 314 whether the ignition key is turned to the OFF position. If the ignition key is turned OFF, the ECU 20 ends the routine shown in FIG. 8. If the ignition key is in the ON state, the ECU 20 returns to Step 312.

If the detecting condition of the evaporative fuel concentration exists in Step 312, the ECU 20 executes the second pressure detection routine in Step 316. The second pressure detection routine (described in greater detail below) is a routine for detecting the mixture pressure and calculating the evaporative fuel concentration. After calculating the evaporative fuel concentration in the second pressure detection routine, the ECU 20 determines in Step 318 whether the purge execution condition exists. If the purge execution condition exists, the ECU 20 returns the processing to Step 310 and performs the purge. If the purge execution condition does not exist, the ECU 20 determines in Step 320 whether the predetermined time has lapsed after the execution of the second pressure detection routine.

If the predetermined time has lapsed after the execution of the second pressure detection routine, the ECU 20 returns to Step 312 because there is the possibility that the evaporative fuel volume adsorbed in the first canister 12 has changed and the evaporative fuel concentration has changed. Thus, the ECU 20 calculates the evaporative fuel concentration with an updated mixture pressure by executing the second pressure detection routine again. If the predetermined time has not lapsed after the execution of the second pressure detection routine, the ECU 20 returns the processing to Step 318.

First Pressure Detection Routine

Processing of the first pressure detection routine will be explained using FIGS. 2-4 and FIG. 9. The first pressure detection routine is executed during purge stop.

Figure 2:
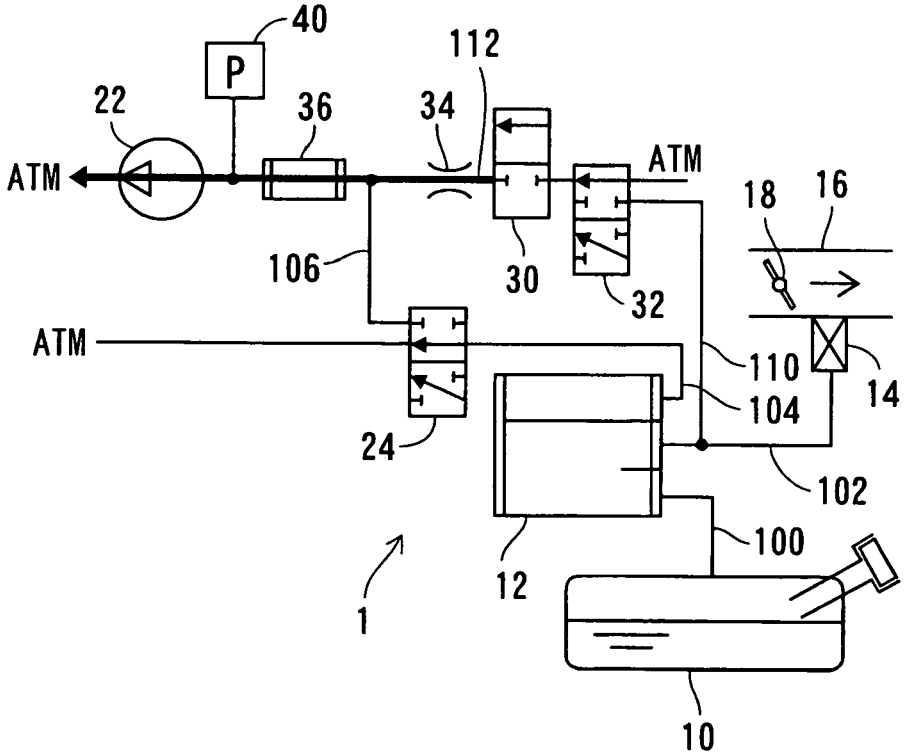
FIG. 2 is a schematic view of the system of FIG. 1 showing a passage state at the time of detection of cutoff pressure during purge stop.

As shown in FIG. 9, the routine begins in Step 400 wherein the ECU 20 actuates the pump 22. Then, in Step 402, the ECU 20 closes the electromagnetic valve 30. Then, in Step 404 the cutoff pressure $P_t$ is detected. More specifically, since the atmosphere side of the reduced area portion 34 is blocked as shown in FIG. 2, the detected pressure of the pressure sensor 40 is the cutoff pressure $P_t$.

Next, in Step 406 the ECU 20 opens the electromagnetic valve 30 (see FIG. 3), and in Step 408, the electromagnetic valve 32 establishes communication of the reduced area portion 34 and the atmosphere. Then, in Step 410, the air pressure $\Delta P_{AIR}$ is detected. More specifically, since only air flows through the reduced area portion 34 in this state, the pressure detected by the pressure sensor 40 is the air pressure $\Delta P_{AIR}$.

Figure 4:
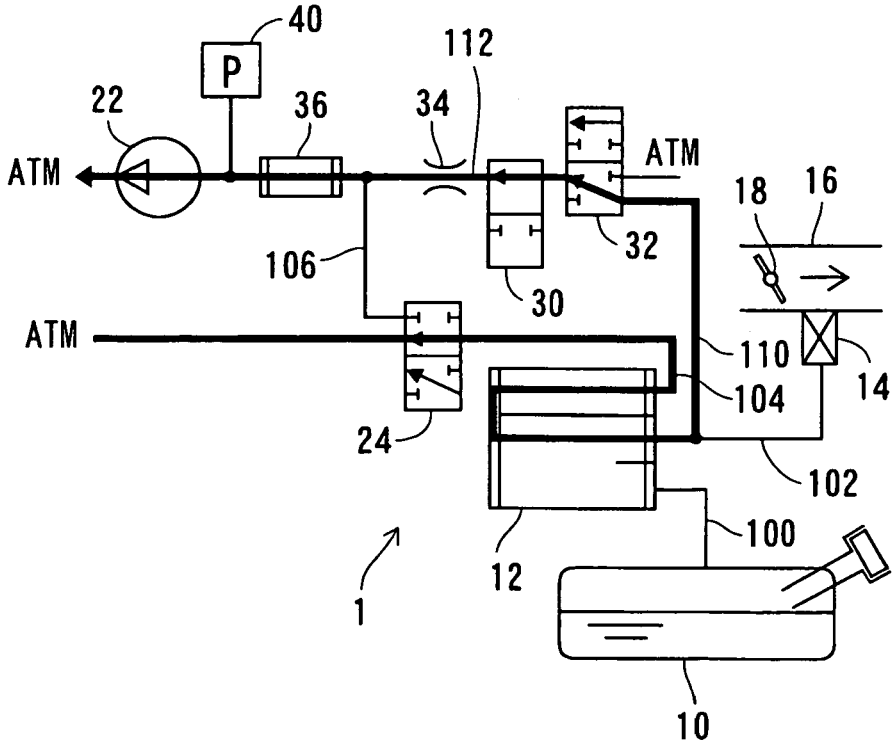
FIG. 4 is a schematic view of the system of FIG. 1 showing a passage state at the time of detection of mixture pressure.

Next, in Step 412 the ECU 20 causes the electromagnetic valve 32 to establish communication between the reduced area portion 34 and the first canister 12 (see FIG. 4). Then, in Step 414 the mixture pressure $\Delta P_{GAS}$ is detected. More specifically, since the mixture of the evaporative fuel adsorbed by the first canister 12 and air flows through the reduced area portion 34, the pressure detected by the pressure sensor 40 is the mixture pressure $\Delta P_{GAS}$.

Subsequently, in Step 416 the ECU 20 calculates the evaporative fuel concentration C from the cutoff pressure $P_t$, the air pressure $\Delta P_{AIR}$, and the mixture pressure $\Delta P_{GAS}$. Then, the ECU 20 stops actuation of the pump 22 in Step 418. Next, in Step 420 the ECU 20 causes the electromagnetic valve 32 to establish communication of the reduced area portion 34 and the atmosphere. Then, in Step 422, the ECU 20 stores the calculated evaporative fuel concentration C in memory (e.g., RAM). Finally, in Step 424 the ECU 20 causes the electromagnetic valve 30 to close.

Purge Routine

Figure 10:
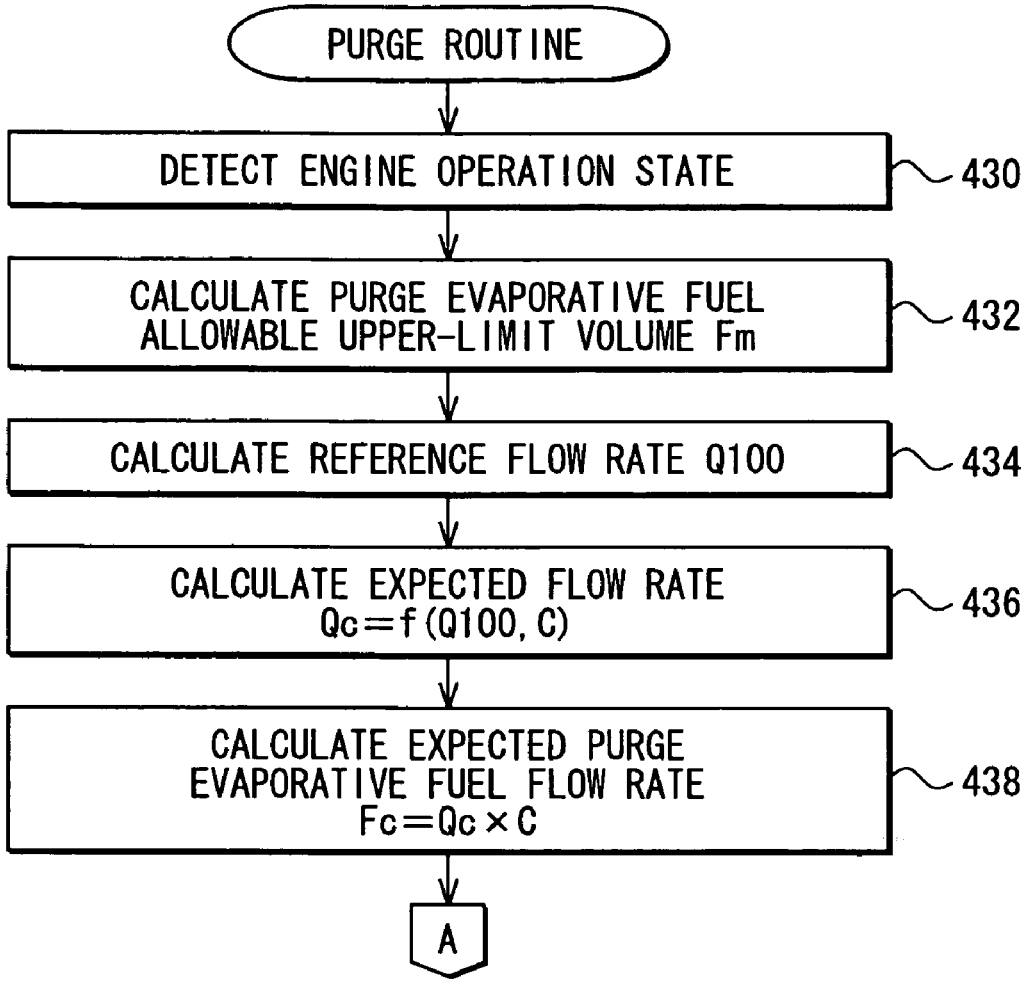
FIG. 10 is a flowchart illustrating a purge method.

One embodiment of the purge routine is shown in FIG. 10. Beginning at Step 430, the ECU 20 detects the engine operation state. More specifically, the ECU 20 detects an engine speed, an intake air volume, an intake pressure, etc. as parameters of the engine operation state. In one embodiment, the intake pressure is calculated from the intake air volume.

Next, in Step 432, the ECU 20 calculates an allowable upper-limit volume Fm by which amount the evaporative fuel is purged to the intake air passage 16. The allowable upper-limit volume Fm is determined according to the engine operation state determined in Step 430. In Step 434, the ECU 20 calculates the reference flow rate Q100. The reference flow rate Q100 represents an air volume that flows through the purging passage 102 at a current intake pressure of the intake air passage 16 when a fluid flowing through the purging passage 102 is 100% air and a degree of opening of the purge valve 14 is 100%.

Then, in Step 436, the ECU 20 calculates an expected flow rate Qc from this reference flow rate Q100 and the evaporative fuel concentration C. The expected flow rate Qc represents a flow rate of the mixture with the evaporative fuel concentration C that flows through the purging passage 102, assuming that the degree of opening of the purge valve 14 is 100%. In Step 438, the ECU 20 calculates the evaporative fuel flow rate Fc flowing through the purging passage 102 from the expected flow rate Qc and the evaporative fuel concentration C, assuming that the degree of opening of the purge valve 14 is 100%.

Figure 11:
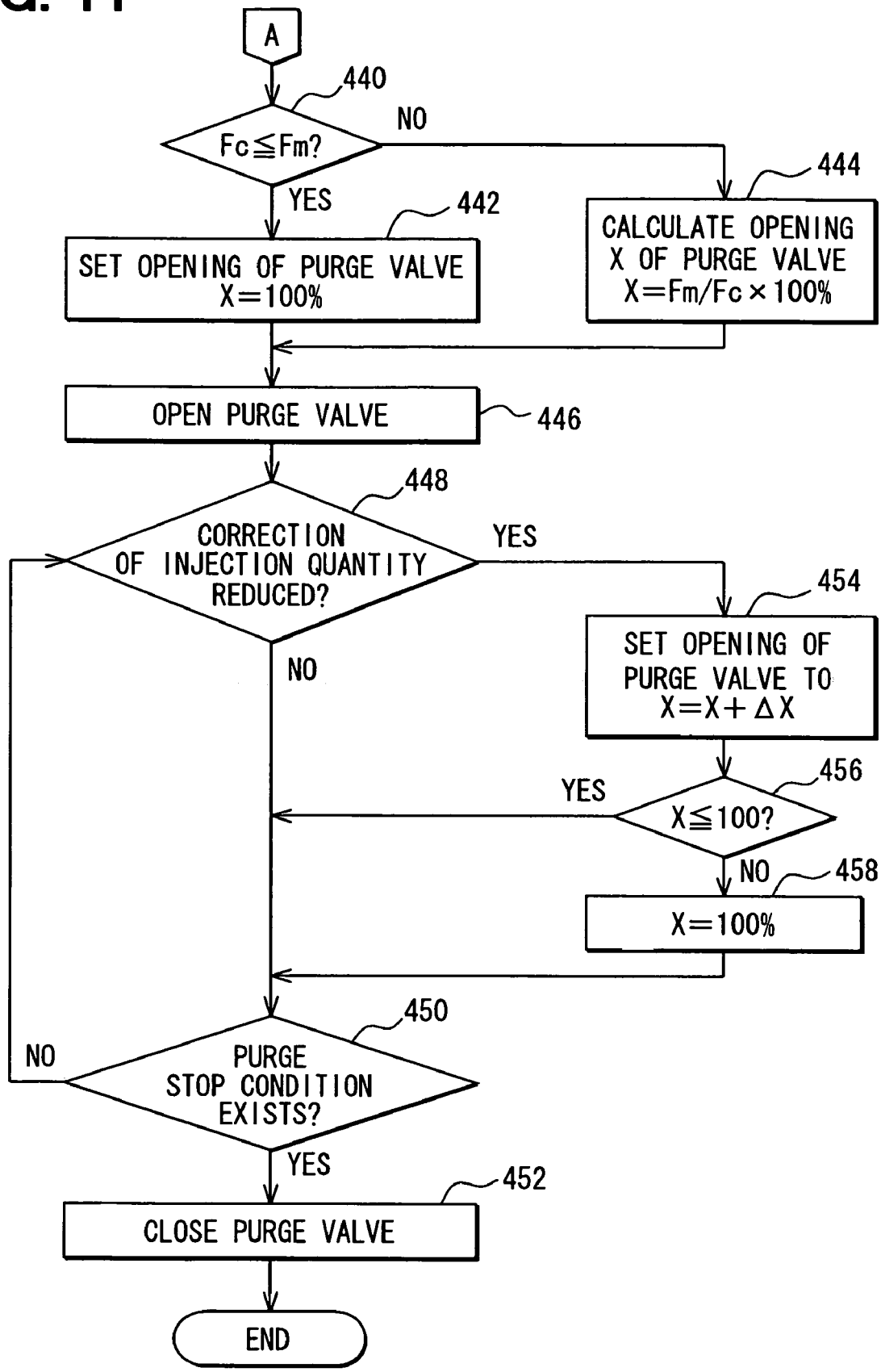
FIG. 11 is a flowchart illustrating a purge method.

Next, in Step 440 shown in FIG. 11, the ECU 20 determines whether evaporative fuel flow rate, Fc, is less than or equal to the allowable upper-limit volume, Fm. If Fc is less than or equal to Fm, the ECU 20 sets the degree of opening of the purge valve 14 to 100% (Step 442). If the evaporative fuel flow rate Fc exceeds the allowable upper-limit volume Fm (i.e., Fc>Fm), and then if the degree of opening of the purge valve 14 is set to 100%, excessive evaporative fuel is purged to the intake air passage 16. Therefore, in Step 444, the ECU 20 adjusts the degree of opening of the purge valve 14. More specifically, the degree of opening X % of the purge valve 14 is set to X=(Fm/Fc)×100.

Next, in Step 446, the ECU 20 opens the purge valve 14. The degree of opening of the purge valve 14 determines the evaporative fuel volume that is purged from the first canister 12. The injection quantity from the fuel injection valve (not shown) is adjusted based on the evaporative fuel volume that is purged. On the other hand, when the evaporative fuel volume adsorbed by the first canister 12 is reduced by the evaporative fuel being purged from the first canister 12, the evaporative fuel volume purged from the first canister 12 to the intake air passage 16 is reduced and the air-fuel ratio is decreased. Since the injection quantity of the fuel injection valve is corrected by the air-fuel ratio being fed back, the injection quantity of the fuel injection valve is set so as to—when the evaporative fuel volume being purged from the first canister 12 to the intake air passage 16 is reduced and the air-fuel ratio is decreased—increase in order to make the air-fuel ratio increase. As a result, a correction of the injection quantity that is a difference between the set injection quantity and the initial value of the injection quantity is decreased.

Thus, as shown in FIG. 11, the ECU 20 in Step 448 determines whether correction of injection quantity is decreased. If the correction of injection quantity is not decreased, namely if the air-fuel ratio is not decreased, and the evaporative fuel volume being purged is not reduced, the ECU 20 determines whether the purge stop condition exists (Step 450). If the purge stop condition does not exist, the ECU 20 returns the processing to Step 448, continuing the purge. If the purge stop condition exists, the ECU 20 closes the purge valve 14 (Step 452) and ends the purge routine.

If the correction of injection quantity is decreased in Step 448, namely if the air-fuel ratio is decreased and the evaporative fuel volume being purged is reduced, the ECU 20 enlarges the degree of opening of the purge valve 14 in order to increase the evaporative fuel volume being purged from the first canister 12 (Step 454). The degree of opening of the purge valve 14 is set to at most 100% (Steps 456 and 458). After setting up the degree of opening of the purge valve 14, the ECU 20 performs the determination of Step 450 as described above.

Second Pressure Detection Routine

Figure 12:
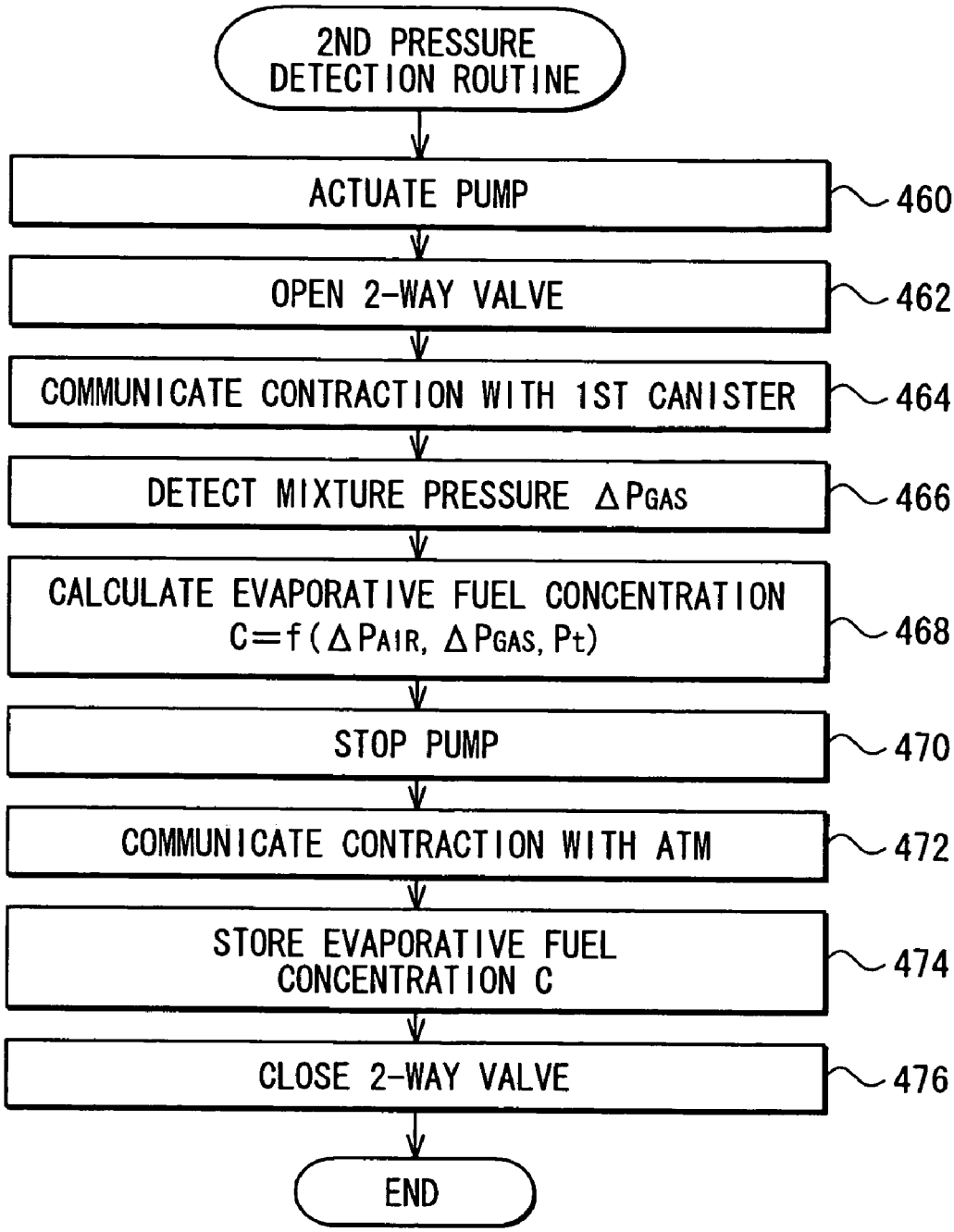
FIG. 12 is a flowchart illustrating a second pressure detection routine.

In the second pressure detection routine shown in FIG. 12, the ECU 20 actuates the pump 22 (Step 460), opens the electromagnetic valve 30 (Step 462), and controls the electromagnetic valve 32 to establish communication between the reduced area portion 34 and the first canister 12 (Step 464). In this state shown in FIG. 4, the mixture of the evaporative fuel and air adsorbed by the first canister 12 flows through the reduced area portion 34, and the detected pressure of the pressure sensor 40 is the mixture pressure $\Delta P_{GAS}$ (Step 466).

The ECU 20 calculates the evaporative fuel concentration C from the mixture pressure $\Delta P_{GAS}$ detected in Step 466 and both the cutoff pressure $P_t$ and the air pressure $\Delta P_{AIR}$, which were previously detected and stored (Step 468). Then the ECU 20 stops actuation of the pump 22 (Step 470), and causes the electromagnetic valve 32 to establish communication between the reduced area portion 34 and the atmosphere (Step 472). Next, in Step 474, the ECU 20 stores the calculated evaporative fuel concentration C in memory (e.g., RAM). Then, in Step 476, the ECU 20 causes the electromagnetic valve 30 to close.

Calculation of Evaporative Fuel Concentration After First Purge

Figure 13:
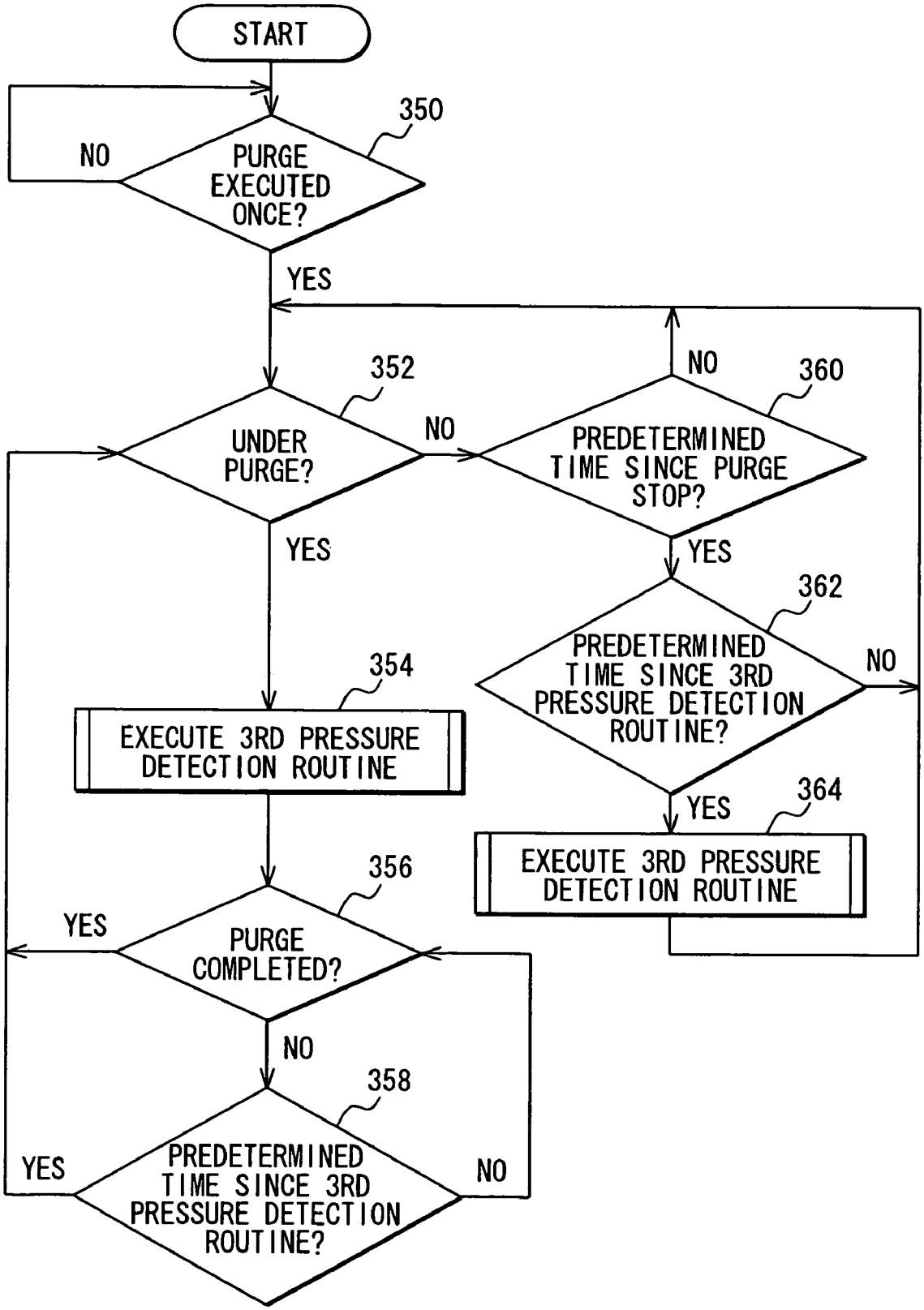
FIG. 13 is a flowchart illustrating a cutoff pressure and air pressure detection method.

A routine shown in FIG. 13 is executed in parallel to the routine shown in FIG. 8. Beginning in Step 350, the ECU 20 determines whether the purge has been completed once (i.e., the first purge). If the first purge is not completed, the ECU 20 waits.

If the first purge is completed, the ECU 20 determines whether the purge is being performed (Step 352). If the purge is being performed, the ECU 20 executes the third pressure detection routine (Step 354). The third pressure detection routine is a routine for detecting the cutoff pressure and the air pressure. If the third pressure detection routine is executed, the ECU 20 determines whether the purge is completed in Step 356. If the purge is completed, the ECU 20 returns the processing to Step 352. If the purge is not completed, the ECU 20 determines whether the predetermined time has lapsed after the last execution of the third pressure detection routine in Step 358, and if the predetermined time has not lapsed, the ECU 20 returns the processing to Step 356.

If the predetermined time has lapsed after the last execution of the pressure detection routine 3 in Step 358, the ECU 20 returns the processing to Step 352, executes the pressure detection routine 3, and detects the cutoff pressure and the air pressure again. Thus, even when the cutoff pressure and the air pressure vary due to a variation of the ambient environment of the evaporative fuel treatment system 1 (e.g., due to a temperature change, etc.) during purge, in the second pressure detection routine (Step 316) of the routines shown in FIG. 8, the evaporative fuel concentration C can be calculated using the updated cutoff pressure and air pressure.

If the purge is not being performed in Step 352, the ECU 20 determines whether the predetermined time has lapsed after the purge stop (Step 360). If the predetermined time has not lapsed after the purge stop, the ECU 20 returns the processing to Step 352. If the predetermined time has lapsed after the purge stop, the ECU 20 determines whether the predetermined time has lapsed after the last execution of the pressure detection routine 3 in Step 362, and if the predetermined time has not lapsed, the ECU 20 returns the processing to Step 352. If the predetermined time has lapsed after the last execution of the pressure detection routine 3, the ECU 20 executes the third pressure detection routine in Step 364 and detects the cutoff pressure and the air pressure again. By these steps, even when the cutoff pressure and the air pressure vary during the purge stop due to ambient environment of the evaporative fuel treatment system 1 (e.g., due to temperature change, etc.), the ECU 20 can calculate the evaporative fuel concentration C using the updated cutoff pressure and air pressure in the pressure detection routine 2 (Step 316) among routines shown in FIG. 8. When the ECU 20 has executed the third pressure detection routine 3 in Step 364, the ECU 20 transfers the processing to Step 352.

Third Pressure Detection Routine

Figure 5:
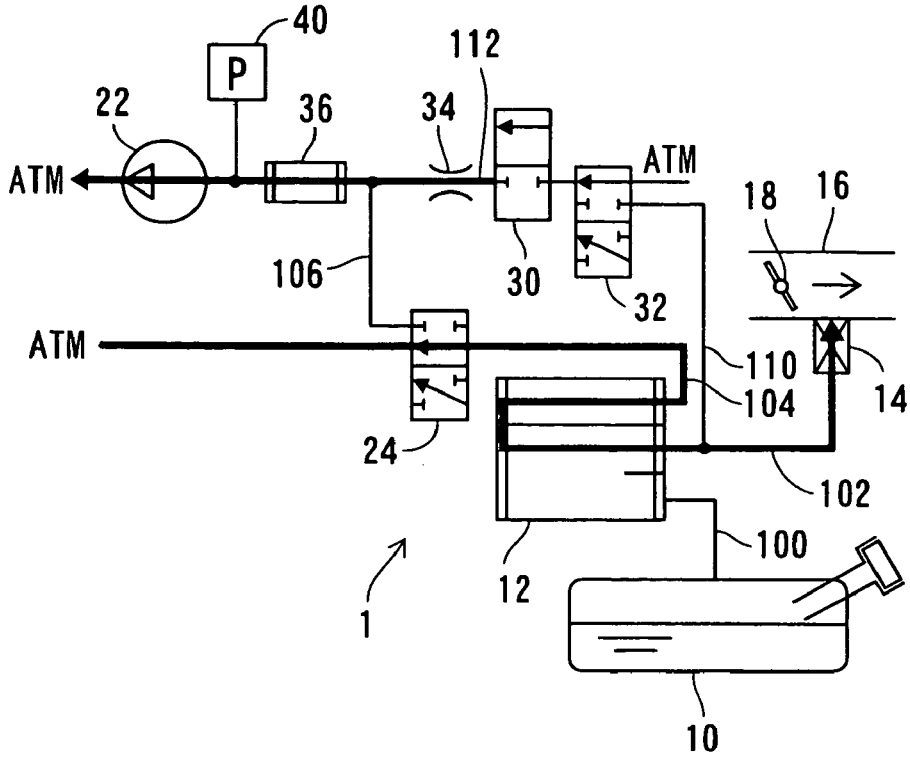
FIG. 5 is a schematic view of the system of FIG. 1 showing a passage state at the time of detection of the cutoff pressure during purge.
Figure 14:
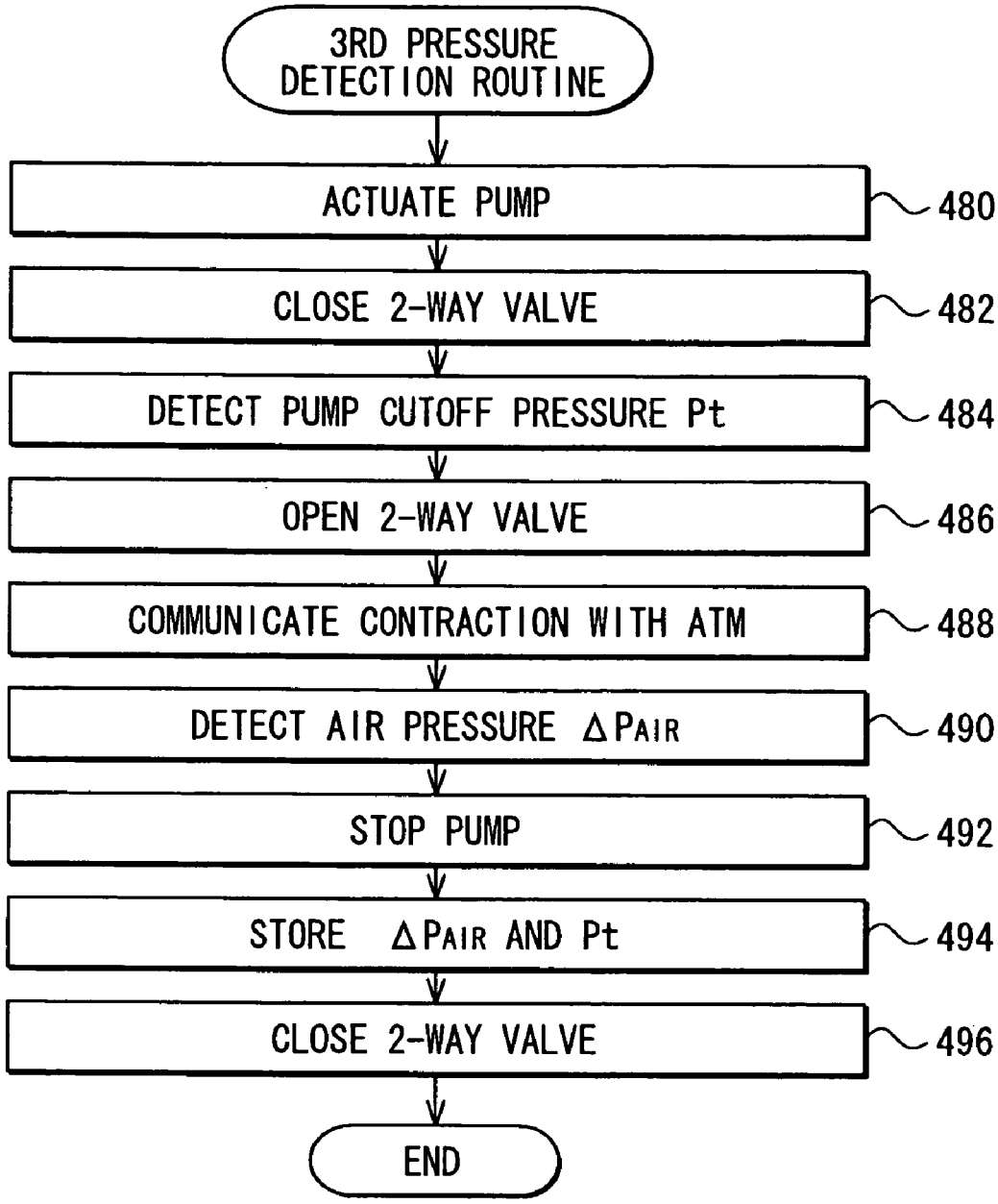
FIG. 14 is a flowchart illustrating a third pressure detection routine.

The routine shown in FIG. 14 begins at Step 480, wherein the ECU 20 actuates the pump 22. Then, the ECU 20 closes the electromagnetic valve 30 (Step 482). Since the atmospheric-air side of the reduced area portion 34 is blocked as shown in FIG. 2 or 5, the detected pressure of the pressure sensor 40 is the cutoff pressure $P_t$ (Step 484). FIG. 5 shows an operation in which the cutoff pressure is detected during the purge.

Figure 3:
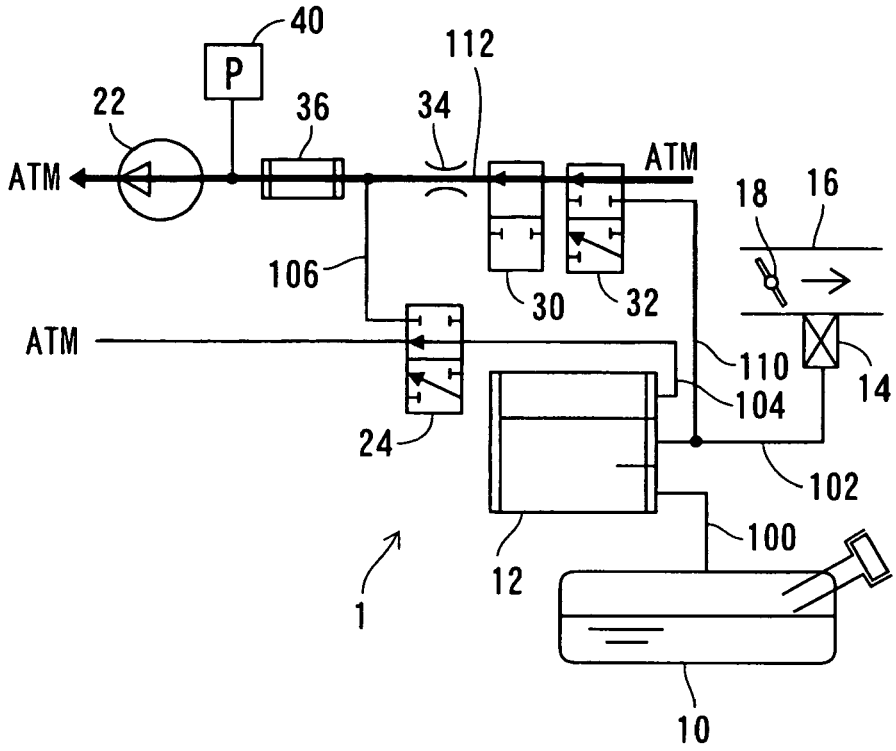
FIG. 3 is a schematic view of the system of FIG. 1 showing a passage state at the time of detection of air pressure during the purge stop.
Figure 6:
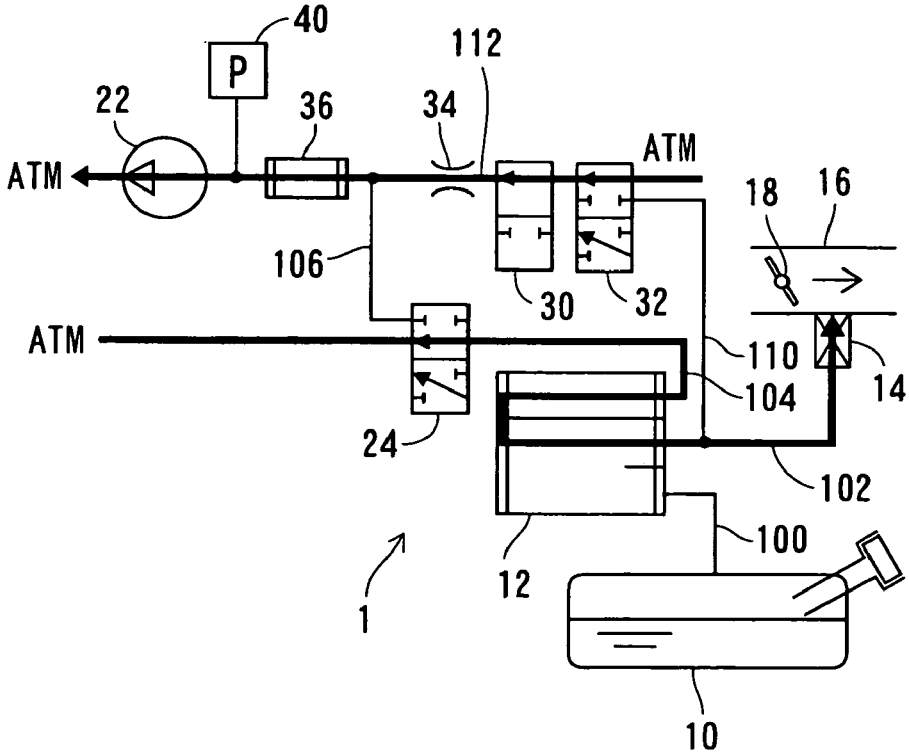
FIG. 6 is a schematic view of the system of FIG. 1 showing a passage state at the time of detection of the cutoff pressure during the purge.
Figure 7:
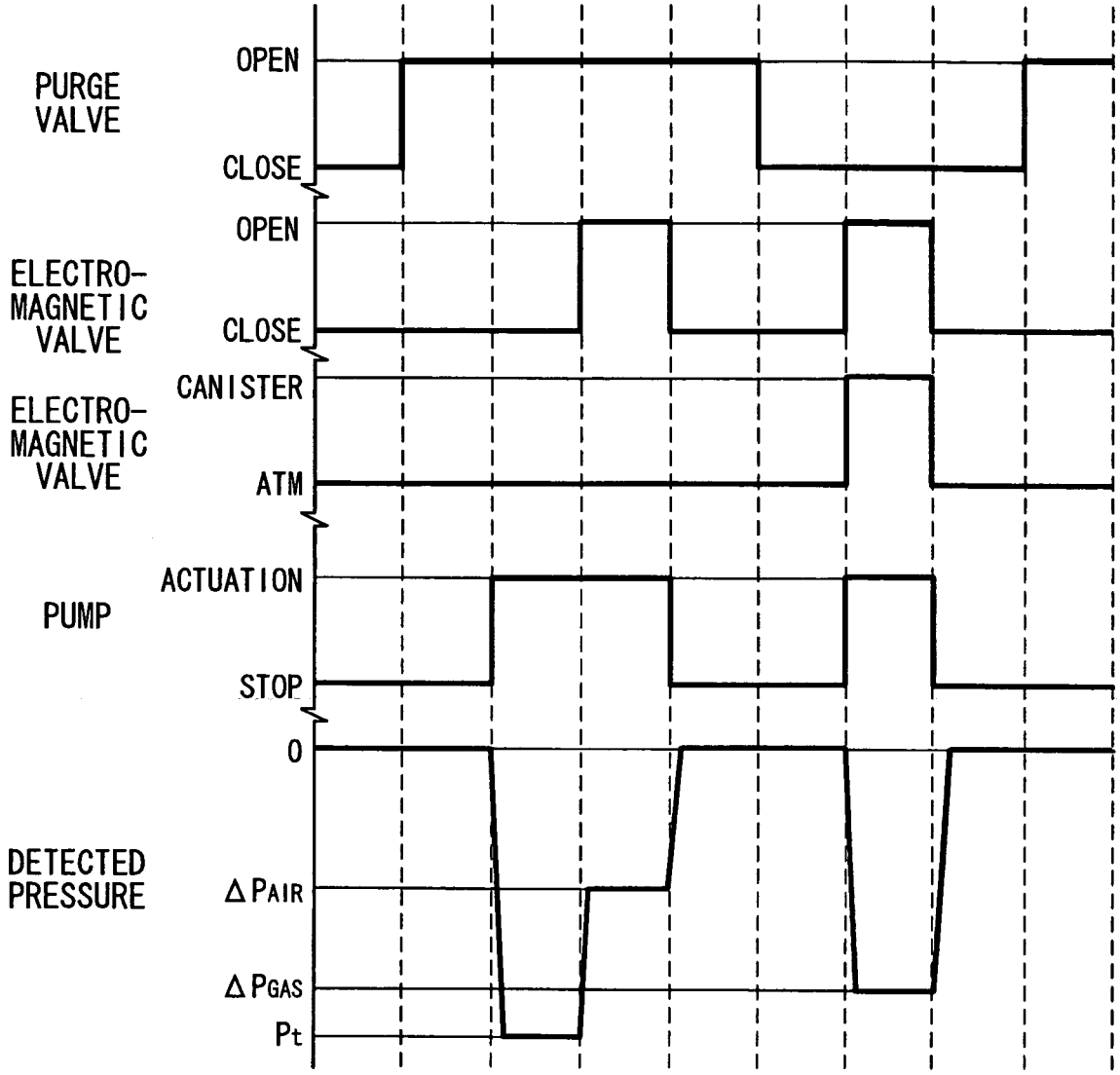
FIG. 7 is a time chart for detecting the cutoff pressure, the air pressure, and the mixture pressure.

Next, as shown in FIG. 3 or 6, the ECU 20 opens the electromagnetic valve 30 (Step 486), and selects a change state in which the electromagnetic valve 32 establishes communication of the reduced area portion 34 and the atmosphere (Step 488). Since only air flows through the reduced area portion 34 in this state, the detected pressure of the pressure sensor 40 is air pressure $\Delta P_{AIR}$ (Step 490). In FIG. 6, the air pressure is detected during the purge.

Next, the ECU 20 stops actuation of the pump 22 (Step 492), and then in Step 494, the ECU 20 stores the detected cutoff pressure $P_t$ and air pressure $\Delta P_{AIR}$ in memory (e.g., RAM). Subsequently, in step 496 the ECU 20 closes the electromagnetic valve 30.

In the embodiment described above, the cutoff pressure and the air pressure are detected during the purge according to the detecting condition after the execution of the first purge, and the mixture pressure is detected during the purge stop. Therefore, in the case where execution of purge and stop of purge are repeated alternately, proper pressures can be detected to detectable timings. Calculation of the evaporative fuel concentration can be completed accurately when the purge execution condition exists on the internal combustion engine side, and thus delay of purge start can be reduced. Accordingly, the number of times of purge and the purge quantity can be increased.

Second Embodiment

Figure 15:
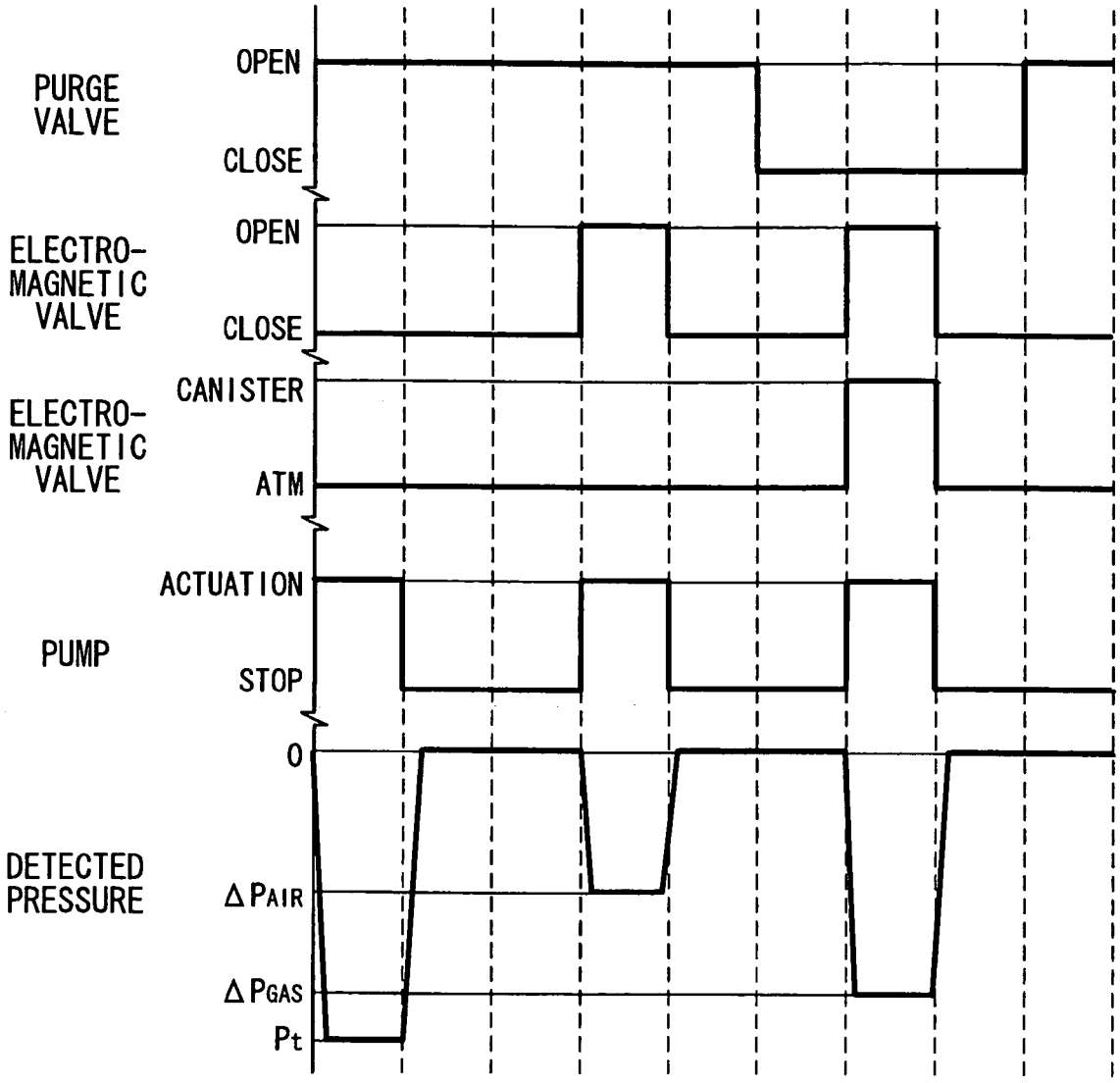
FIG. 15 is a time chart for detecting the cutoff pressure, the air pressure, and the mixture pressure according to a second embodiment.
Figure 16:
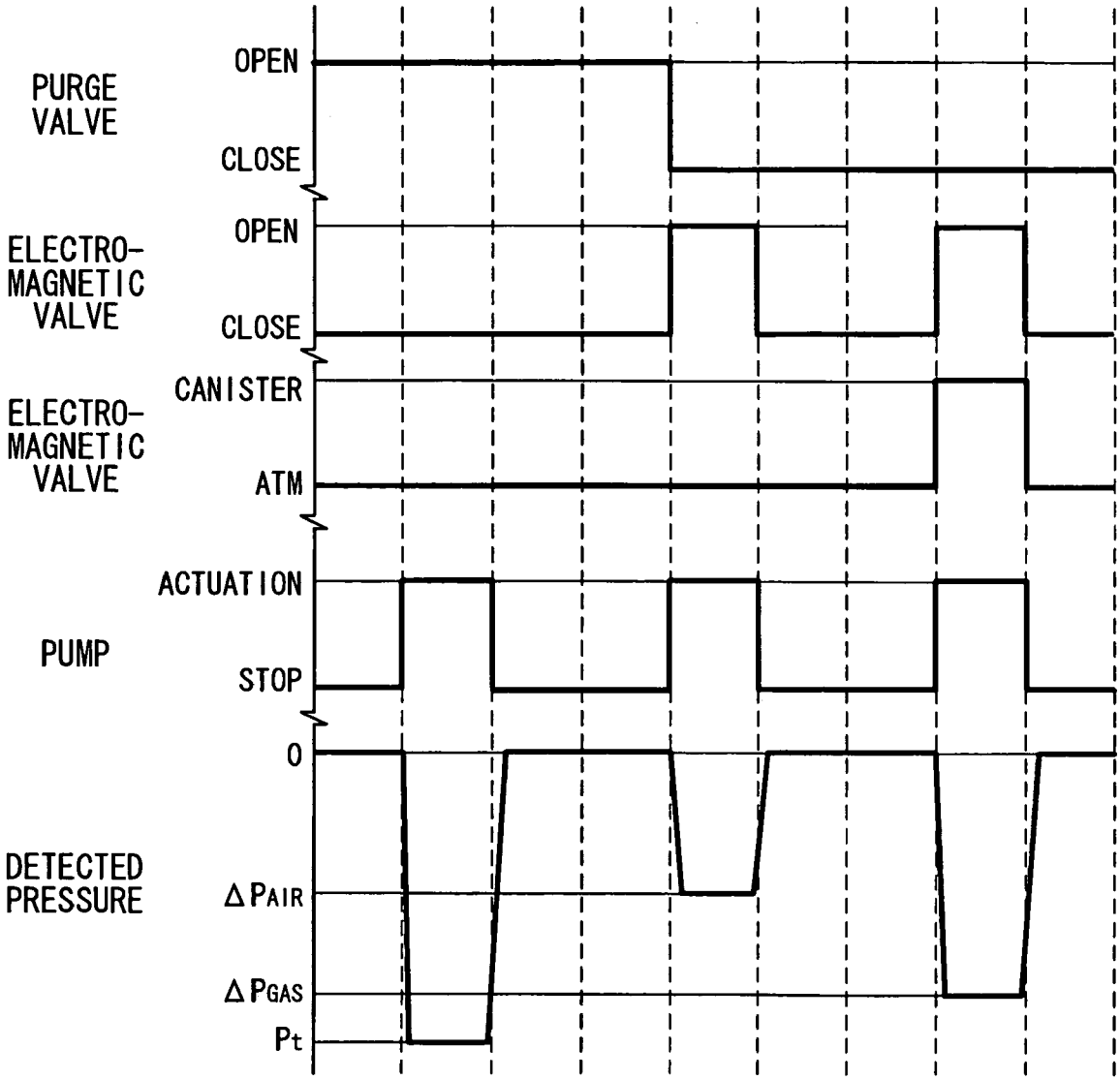
FIG. 16 is a time chart according to a variation of the embodiment of FIG. 15.
Figure 17:
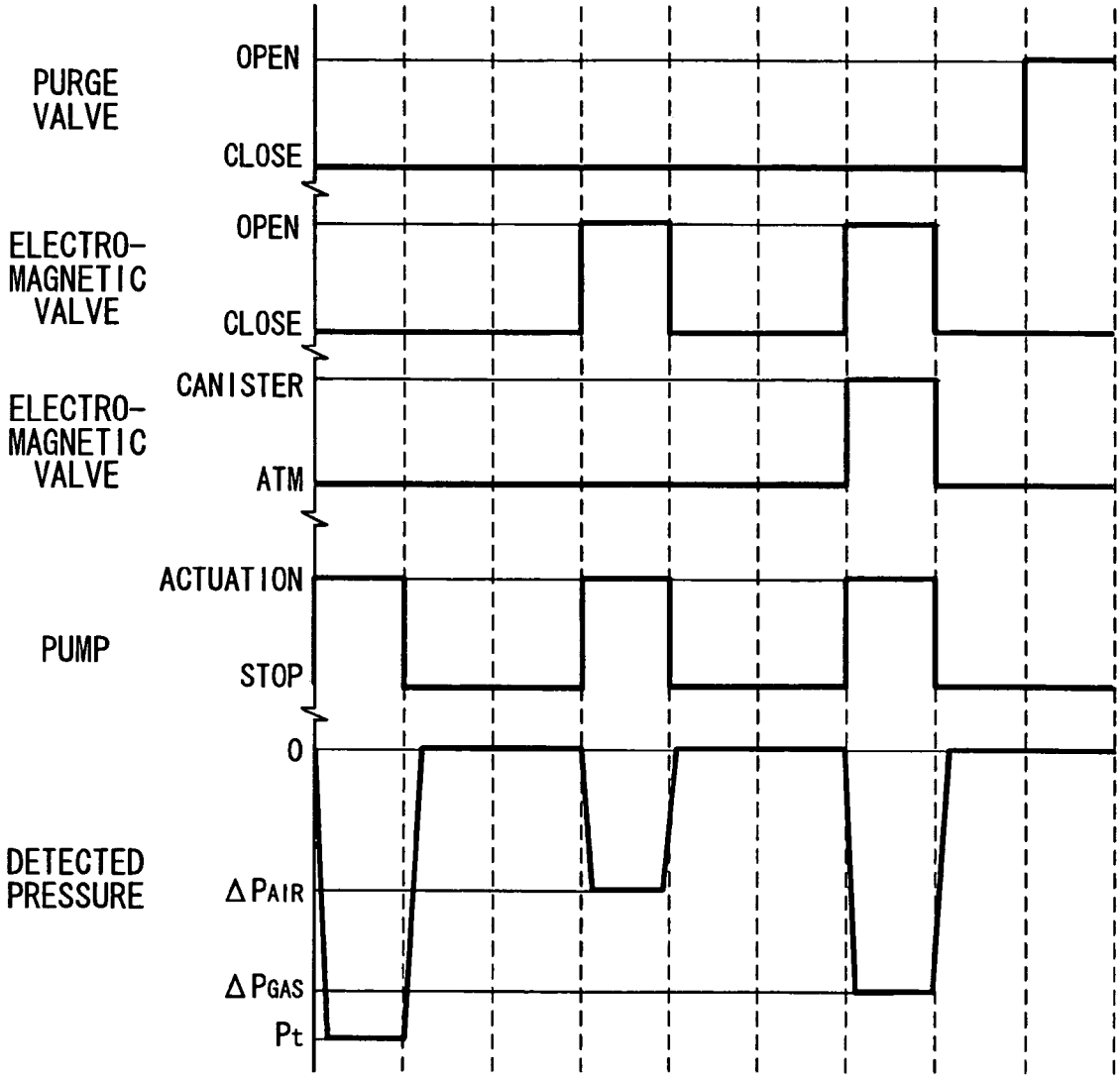
FIG. 17 is a time chart according to another variation of the embodiment of FIG. 15.

FIG. 15 shows a time chart of an evaporative fuel treatment system according to a second embodiment. FIG. 16 shows a variation of this embodiment, and FIG. 17 shows another variation.

In the second embodiment and its variations, the cutoff pressure, the air pressure, and the mixture pressure are detected independently and discontinuously, respectively.

In the second embodiment shown in FIG. 15, the cutoff pressure $P_t$ and the air pressure $\Delta P_{AIR}$ are detected on a discontinuous basis during the purge, and the mixture pressure $\Delta P_{GAS}$ is detected during the purge stop on a discontinuous basis with the cutoff pressure $P_t$ and the air pressure $\Delta P_{AIR}$.

In the variation shown in FIG. 16, the cutoff pressure $P_t$ is detected during the purge, and the air pressure $\Delta P_{AIR}$ and the mixture pressure $\Delta P_{GAS}$ are detected mutually and independently on a discontinuous basis with the cutoff pressure $P_t$.

In the variation shown in FIG. 17, the cutoff pressure $P_t$, the air pressure $\Delta P_{AIR}$, and the mixture pressure $\Delta P_{GAS}$ are detected independently, respectively, on a discontinuous basis.

In this way, since the cutoff pressure, the air pressure, and the mixture pressure are detected independently, respectively, on a discontinuous basis, a detection time for detecting one of the pressures is relatively short as compared with detection of pressures on a continual basis. Therefore, pressures can be detected properly even in the case where a time allowed for pressure detection is short.

In this way, by increasing a frequency of detecting a pressure necessary for calculation of the evaporative fuel concentration, the evaporative fuel concentration can be accurately calculated when a purge execution condition exists. Therefore, there will be less delay for starting the purge. Also, the frequency of purging and the purge quantity can be increased.

In the second embodiment and the variation shown in FIG. 16, at least one of the cutoff pressure and the air pressure is detected during the purge, and the mixture pressure is detected during the purge stop. Therefore, in the case where purge start and purge stop are repeated alternately, proper pressures can be detected to detectable timings.

Third Embodiment

Figure 18:
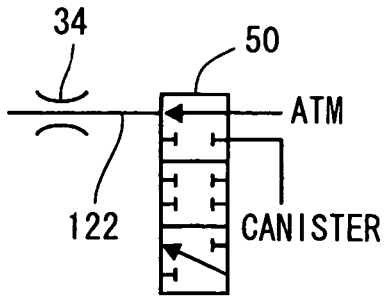
FIG. 18 is a schematic view of a switching device suitable for use in the evaporative fuel treatment system.
Figure 19:
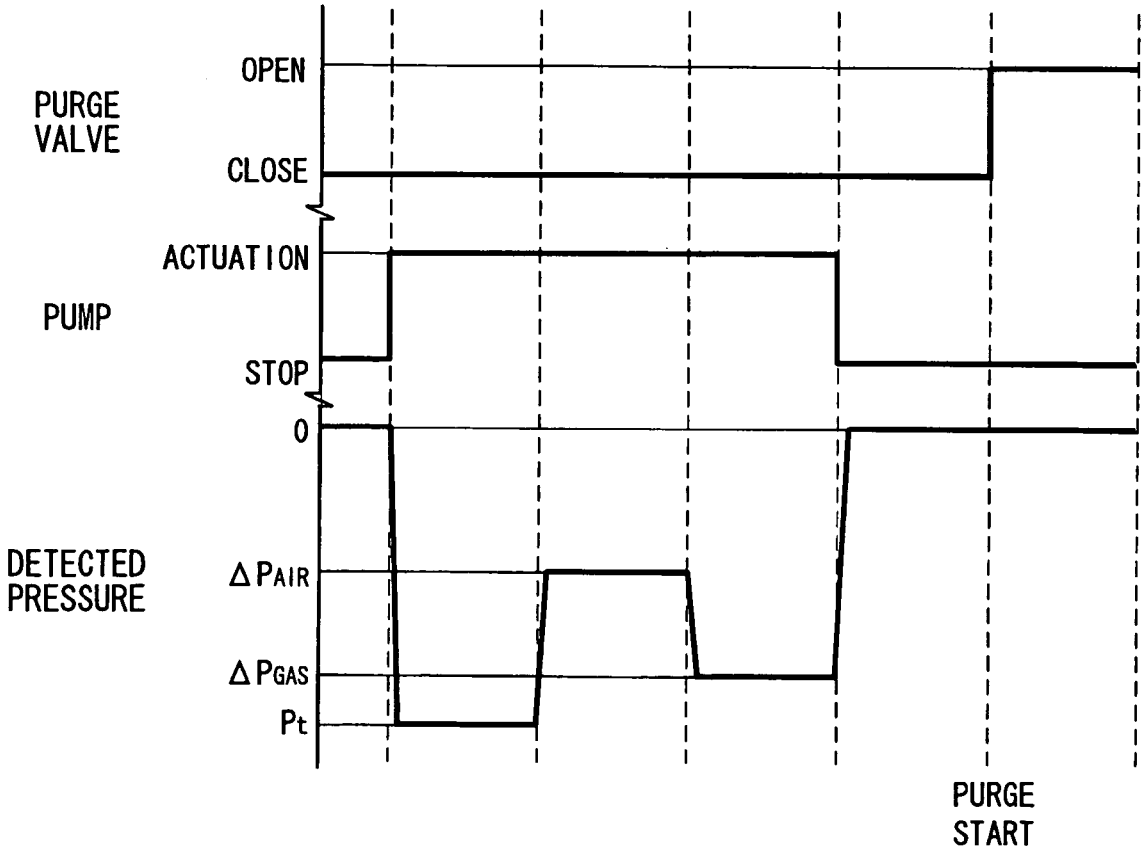
FIG. 19 is a time chart for detecting the cutoff pressure, the air pressure, and the mixture pressure according to the prior art.

A third embodiment is illustrated in FIG. 18. In this embodiment, the switching device is different. More specifically, instead of the switching device of the first embodiment constructed of the electromagnetic valves 30, 32, the switching device includes a single electromagnetic valve 50.

Other Embodiments

In the multiple embodiments described in the foregoing, the cutoff pressure is detected first, then the air pressure is detected, and then the mixture pressure is detected. However, these three pressures may be detected in any suitable order, as long as they are detected in detectable timings.

Moreover, in the multiple embodiments, the second canister 36 is provided in the detection passage 112 between the pump 22 and the reduced area portion 34 to enlarge the detection gain of a differential value between the air pressure $\Delta P_{AIR}$ and the mixture pressure $\Delta P_{GAS}$. However, a configuration in which the second canister 36 is not installed may be adopted.

Moreover, if the predetermined time has lapsed after the detection of any one of the cutoff pressure, the air pressure, and the mixture pressure, a pressure among the cutoff pressure, a pressure when at least the predetermined time has lapsed after its detection may be detected again, among the cutoff pressure, the air pressure and the mixture pressure, according to the detecting condition in the second embodiment, the variation 1, or the variation 2.

Moreover, the pump 22 is used not only in the calculation of the evaporative fuel concentration but also in leak check of the evaporative fuel system. However, the leak check of the evaporative fuel concentration may be performed using another pump.

While only the selected embodiments have been chosen to illustrate the present invention, it will be apparent to those skilled in the art from this disclosure that various changes and modifications can be made therein without departing from the scope of the invention as defined in the appended claims. Furthermore, the foregoing description of the preferred embodiments according to the present invention is provided for illustration only, and not for the purpose of limiting the invention as defined by the appended claims and their equivalents.

What is claimed is:

1. A evaporative fuel treatment system, comprising:

a canister into which an evaporative fuel is adsorbed and from which the evaporative fuel is purged into an intake air passage of an internal combustion engine;

a detection passage having a reduced area portion;

a switching device that switches among communication of the reduced area portion and an atmosphere, communication of the reduced area portion and the canister, and shutoff of communication between the reduced area portion, the atmosphere, and the canister;

a depressurizing device coupled to the detection passage on a side of the reduced area portion opposite to the switching device, the depressurizing device operable for depressurizing the detection passage;

a pressure detecting device for detecting a pressure in the detection passage; and an evaporative fuel state calculating device for calculating an evaporative fuel state in the mixture based on a cutoff pressure detected by the pressure detecting device when the depressurizing device is in operation and when the switching device shuts off communication between the atmosphere and the canister, an air pressure detected by the pressure detecting device when the reduced area portion and the atmosphere are in communication and when the switching device shuts off communication between the reduced area portion and the canister, and a mixture pressure of a mixture of air and the evaporative fuel detected by the pressure detecting device when the switching device shuts off communication between the reduced area portion and the atmosphere and the reduced area portion and the canister are in communication during purge stop of the evaporative fuel from the canister to the intake air passage, wherein the cutoff pressure, the air pressure, and the mixture pressure are detected independently and discontinuously.

2. The evaporative fuel treatment system according to claim 1, wherein the pressure detecting device detects at least one of the cutoff pressure and the air pressure during purge of the evaporative fuel from the canister to the intake air passage.

3. The evaporative fuel treatment system according to claim 1, wherein, the evaporative fuel state calculating device controls the switching device and the depressurizing device and makes the pressure detecting device detect a pressure when the predetermined time has lapsed after the detection of the at least one of the cutoff pressure and the air pressure.

4. The evaporative fuel treatment system according to claim 1, wherein after a predetermined time has lapsed after the detection of the mixture pressure, the evaporative fuel state calculating device controls operations of the switching device and of the depressurizing device and causes the pressure detecting device to detect the mixture pressure.

5. The evaporative fuel treatment system according to claim 1, wherein the evaporative fuel state is a concentration of the evaporative fuel.

6. The evaporative fuel treatment system according to claim 1, wherein the pressure detecting device detects pressure in the detection passage between the reduced area portion and the depressurizing device.

7. The evaporative fuel treatment system according to claim 1, wherein the pressure detecting device detects pressure in the detection passage on both sides of the reduced area portion.

8. The evaporative fuel treatment system according to claim 1, wherein the pressure detecting device is a relative pressure sensor for detecting a relative pressure with respect to the atmosphere.

9. The evaporative fuel treatment system according to claim 1, wherein the pressure detecting device is an absolute pressure sensor for detecting an absolute pressure.

10. The evaporative fuel treatment system according to claim 1, wherein the pressure detecting device is differential pressure detecting device for detecting a differential pressure on both sides of the reduced area portion.

11. An evaporative fuel treatment system, comprising:

a canister into which evaporative fuel is adsorbed and from which the evaporative fuel is purged into an intake air passage of an internal combustion engine;

a detection passage having a reduced area portion;

a switching device that switches among communication of the reduced area portion and an atmosphere, communication of the reduced area portion and the canister, and shutoff of communication between the reduced area portion, the atmosphere, and the canister;

a depressurizing device coupled to the detection passage on a side of the reduced area portion opposite to the switching device, the depressurizing device operable for depressurizing the detection passage;

a pressure detecting device for detecting a pressure in the detecting passage; and an evaporative fuel state calculating device for calculating an evaporative fuel state in the mixture based on a cutoff pressure detected by the pressure detecting device when the depressurizing device is in operation and when the switching device shuts off communication between the atmosphere and the canister, an air pressure detected by the pressure detecting device when the reduced area portion and the atmosphere are in communication and when the switching device shuts off communication between the reduced area portion and the canister, and a mixture pressure of a mixture of air and the evaporative fuel detected by the pressure detecting device when the switching device shuts off communication between the reduced area portion and the atmosphere and the reduced area portion and the canister are in communication during purge stop of the evaporative fuel from the canister to the intake air passage, wherein the cutoff pressure and the air pressure are detected on a continual basis during purge of the evaporative fuel from the canister to the intake air passage.

12. The evaporative fuel treatment system according claim 11, wherein, when a predetermined time has lapsed after the detection of the cutoff pressure and the air pressure, the evaporative fuel state calculating device controls operations of the switching device and the depressurizing device and causes the pressure detecting device to detect the cutoff pressure and the air pressure.

13. The evaporative fuel treatment system according to claim 11, wherein after a predetermined time after the detection of the mixture pressure, the evaporative fuel state calculating device controls operations of the switching device and of the depressurizing device and causes the pressure detecting device to detect the mixture pressure.

14. The evaporative fuel treatment system according to claim 11, wherein the evaporative fuel state is a concentration of the evaporative fuel.

15. The evaporative fuel treatment system according to claim 11, wherein the pressure detecting device detects pressure in the detection passage between the reduced area portion and the depressurizing device.

16. The evaporative fuel treatment system according to claim 11, wherein the pressure detecting device detects pressure in the detection passage on both sides of the reduced area portion.

17. The evaporative fuel treatment system according to claim 11, wherein the pressure detecting device is a relative pressure sensor for detecting a relative pressure with respect to the atmosphere.

18. The evaporative fuel treatment system according to claim 11, wherein the pressure detecting device is an absolute pressure sensor for detecting an absolute pressure.

19. The evaporative fuel treatment system according to claim 11, wherein the pressure detecting device is differential pressure detecting device for detecting a differential pressure on both sides of the reduced area portion.

* * * * *